US011001780B2

(12) United States Patent
Lee et al.

(10) Patent No.: US 11,001,780 B2
(45) Date of Patent: May 11, 2021

(54) CUTTING OIL COMPOSITION

(71) Applicant: YOUNG CHANG CHEMICAL CO., LTD, Gyeongsangbuk-do (KR)

(72) Inventors: Seung Hun Lee, Daegu (KR); Seung Hyun Lee, Daegu (KR); Seong Hwan Kim, Daegu (KR); Gyeong Guk Ham, Daegu (KR)

(73) Assignee: YOUNG CHANG CHEMICAL CO., LTD, Gyeongsangbuk-Do (KR)

( * ) Notice: Subject to any disclaimer, the term of this patent is extended or adjusted under 35 U.S.C. 154(b) by 0 days.

(21) Appl. No.: 16/609,685

(22) PCT Filed: May 31, 2018

(86) PCT No.: PCT/KR2018/006190

§ 371 (c)(1),
(2) Date: Oct. 30, 2019

(87) PCT Pub. No.: WO2018/221972

PCT Pub. Date: Dec. 6, 2018

(65) Prior Publication Data

US 2020/0190423 A1 Jun. 18, 2020

(30) Foreign Application Priority Data

Jun. 1, 2017 (KR) ..... 10-2017-0068590
May 30, 2018 (KR) ..... 10-2018-0061490

(51) Int. Cl.
*C10M 169/02* (2006.01)
*C10M 169/04* (2006.01)
*C10M 113/10* (2006.01)
*C10N 40/22* (2006.01)

(52) U.S. Cl.
CPC ..... *C10M 169/02* (2013.01); *C10M 113/10* (2013.01); *C10M 169/04* (2013.01); *C10M 2201/1036* (2013.01); *C10M 2207/127* (2013.01); *C10N 2040/22* (2013.01)

(58) Field of Classification Search
CPC ..... C10M 107/02; C10M 107/14; C10M 107/16; C10M 107/20; C10M 107/24; C10M 169/02; C10M 169/04; C10M 113/10
USPC ..... 72/42
See application file for complete search history.

(56) References Cited

U.S. PATENT DOCUMENTS 5,072,067 A * 12/1991 Koyama ..... C10M 173/00 585/3
6,383,991 B1 * 5/2002 Hashimoto ..... C10M 125/26 508/161
6,602,834 B1 * 8/2003 Ward ..... C10M 169/045 508/506
2010/0043301 A1 * 2/2010 Yoon ..... C10M 173/02 51/298
2012/0040878 A1 * 2/2012 Katayama ..... C08F 10/00 508/591
2012/0186571 A1 * 7/2012 Zhu ..... C10M 173/02 125/21
2015/0315513 A1 * 11/2015 Zhu ..... C10M 173/02 125/12

FOREIGN PATENT DOCUMENTS

JP 10-053789 A 2/1998
JP 2006-111728 A 4/2006
KR 10-0418258 B1 2/2004
KR 10-2006-0021828 A 3/2006
KR 10-0665790 B1 1/2007
KR 10-0821589 B1 4/2008
KR 10-2009-0048518 A 5/2009
KR 10-2009-0065847 A 6/2009
KR 10-2010-0133907 A 12/2010
KR 10-2011-0039725 A 4/2011
KR 10-2012-0021737 A 3/2012
WO 2015-053192 A1 4/2015

* cited by examiner

*Primary Examiner* — Ellen M McAvoy
(74) *Attorney, Agent, or Firm* — Novick, Kim & Lee, PLLC; Jae Youn Kim

(57) ABSTRACT

Disclosed is a cutting oil composition, which is vastly superior in view of layer separation, dispersibility, viscosity, ingot-cleaning time after sawing, and wafer warpage after sawing, compared to conventional cutting oil compositions, and which includes mineral oil that is highly hydrogenated, as represented by Chemical Formulas 1 to 3, bentonite clay as a thickener, and glycerol trioleate as a dispersant. A cutting method using the cutting oil composition is also provided.

5 Claims, No Drawings

CUTTING OIL COMPOSITION

TECHNICAL FIELD

The present invention relates to a cutting oil composition for use in a wiresaw cutting process. In particular, the present invention relates to a wiresaw cutting oil composition including a highly hydrogenated hydrocarbon distillate, a thickener and a dispersant.

BACKGROUND ART

Wiresaw cutting is the main process of slicing ingots to manufacture thin wafers for use in integrated circuits and in the photovoltaic industry.

Additionally, this process is typically used in the manufacture of a substrate of a predetermined material, such as sapphire, silicon carbide or ceramic, as a wafer.

A wiresaw typically has a web or wire web of fine metal wires, in which the individual wires have a diameter of about 0.15 mm and are arranged parallel to each other at a distance of 0.1 to 1.0 mm through a series of spools, pulleys and wire guides. Cutting is accomplished by bringing a workpiece such as a substrate into contact with a moving wire to which a cutting oil composition is applied.

A conventional wiresaw cutting process is performed using a composition prepared by mixing a cutting oil composition including mineral oil, a thickener, a dispersant, etc. with abrasive particles composed of a hard material such as silicon carbide particles at a weight ratio of about 1:1.

A cutting oil composition is a liquid that provides lubrication and cooling and allows the abrasive to contact the workpiece being cut by helping the abrasive remain on the wire.

In order for the cutting oil to function optimally, a proper balance of lubricity and viscosity is required. If lubricity is excessive, fine abrasive particles do not adhere to the workpiece and cutting capability is thus reduced, whereas if lubricity is insufficient, individual fine abrasive particles do not exhibit sufficient cutting capability.

A cutting oil composition may include a non-aqueous material, for example, mineral oil, kerosene, polyethylene glycol, polypropylene glycol or other polyalkylene glycol, and a hydrophilic material may also be used in the wiresaw cutting process.

DISCLOSURE

Technical Problem

The present invention pertains to a cutting oil composition for use in a wiresaw cutting process. Existing cutting oil compositions are problematic because of layer separation, low dispersibility, extremely low or high viscosity, excessively long ingot-cleaning time after sawing, and large wafer warpage after sawing.

Specifically, the conventional cutting oil composition is regarded as inappropriate because at least one of layer separation, dispersibility, viscosity, cleaning time after sawing, and wafer warpage after sawing is evaluated to be poor.

The present invention is capable of providing a cutting oil composition, in which at least one of layer separation, dispersibility, viscosity, cleaning time after sawing, and wafer warpage after sawing is evaluated not to be poor, and all of them are vastly superior, compared to conventional cutting oil compositions.

Technical Solution

According to the present invention, a highly hydrogenated hydrocarbon represented by Chemical Formula 1 below is invented, and a cutting oil composition, which is vastly superior in view of layer separation, dispersibility, viscosity, ingot-cleaning time after sawing, and wafer warpage after sawing by mixing the highly hydrogenated hydrocarbon represented by Chemical Formulas 1 to 3 with a thickener and a dispersant, is obtained, culminating in the present invention.

An embodiment of the present invention provides a cutting oil composition, including mineral oil, which is a highly hydrogenated hydrocarbon, as represented by Chemical Formulas 1 to 3 below.

$$R1\text{-}(CnH2n\text{-}4)a\text{-}R2 \quad \text{[Chemical Formula 1]}$$

$$R3\text{-}(CnH2n\text{-}2)b\text{-}R4 \quad \text{[Chemical Formula 2]}$$

$$R5\text{-}(CnH2n)c\text{-}R6 \quad \text{[Chemical Formula 3]}$$

In Chemical Formulas 1 to 3, n is 5 or 6, and R1, R2, R3, R4, R5 and R6 are each H or OH.

In the cutting oil composition, including mineral oil, which is a highly hydrogenated hydrocarbon, according to the embodiment of the present invention, a of Chemical Formula 1 is 7 to 20, b of Chemical Formula 2 is 39 to 52, and c of Chemical Formula 3 is 39 to 41.

The cutting oil composition according to the embodiment of the present invention may further include a thickener and a dispersant.

In the cutting oil composition according to the embodiment of the present invention, the thickener may be bentonite clay and the dispersant may be glycerol trioleate.

The cutting oil composition according to the embodiment of the present invention may include 65 to 93 wt % of mineral oil, 0.7 to 3 wt % of bentonite, and 5 to 35 wt % of glycerol trioleate, and particularly 70 to 90 wt % of mineral oil, 1 to 2 wt % of bentonite, and 9 to 29 wt % of glycerol trioleate.

Another embodiment of the present invention provides a cutting method using the cutting oil composition described above.

Advantageous Effects

According to the present invention, the present invention is effective at providing a cutting oil composition that is vastly superior in view of layer separation, dispersibility, viscosity, wafer-cleaning time after sawing, and wafer warpage after sawing.

BEST MODE

Unless otherwise defined, all technical and scientific terms used herein have the same meanings as those typically understood by those skilled in the art to which the present invention belongs. Generally, the nomenclature used herein is well known in the art and is typical.

As used herein, when any part is said to "include" any element, this does not mean that other elements are excluded, and such other elements may be further included unless otherwise specifically mentioned.

Examples

In the following Examples and Comparative Examples carried out on the items A, B, C and D, evaluation was performed based on the following criteria.

1) Measurement of Viscosity:

Viscosity was measured using a DV-II+ Pro model from Brookfield and Spindle No. 62 at 50 rpm. Here, a viscosity of 90 to 140 mPa·s at 25° C. indicates appropriateness for a cutting oil composition.

2) Measurement of Layer Separation:

Whether layer separation occurred was evaluated by mixing cutting oil with silicon carbide (SiC). Specifically, cutting oil and SiC were mixed at a weight ratio of 1:1 and allowed to stand at room temperature for 24 hr, after which whether layer separation occurred at the top of the liquid was observed with the naked eye and categorized according to whether or not layer separation occurred. Here, the absence of layer separation indicates appropriateness for a cutting oil composition.

3) Measurement of Dispersibility:

Dispersibility was evaluated by mixing cutting oil with silicon carbide (SiC), and the extent of dispersion of SiC in cutting oil was observed with the naked eye and determined to be good or poor. The result evaluated to be good indicates appropriateness for a cutting oil composition.

4) Measurement of Wafer-Cleaning Time after Sawing:

The wafer-cleaning time after sawing was evaluated by measuring the time taken to remove most of cutting oil and SiC from the wafer immersed in a cleaning solution after sawing. A result of 60 min or less is regarded as superior for a cutting oil composition.

5) Measurement of Wafer Warpage after Sawing:

The wafer warpage after sawing was evaluated by measuring the extent of warping of the cleaned wafer using a meter. Here, the result of evaluation of wafer warpage of 10 μm or less after sawing is regarded as superior for a cutting oil composition.

MODE FOR INVENTION

A. Examples 1 to 3 and Comparative Examples 1 and 2: Evaluation of Numeric Values of a of Chemical Formula 1, b of Chemical Formula 2, and c of Chemical Formula 3

In the cutting oil composition including mineral oil represented by Chemical Formulas 1 to 3 below, evaluation for determining the numeric values of a of Chemical Formula 1, b of Chemical Formula 2, and c of Chemical Formula 3 was performed. The results are shown in Table 1 below.

$$R1\text{-}(CnH2n\text{-}4)a\text{-}R2 \quad \text{[Chemical Formula 1]}$$

$$R3\text{-}(CnH2n\text{-}2)b\text{-}R4 \quad \text{[Chemical Formula 2]}$$

$$R5\text{-}(CnH2n)c\text{-}R6 \quad \text{[Chemical Formula 3]}$$

In Chemical Formulas 1 to 3, n is 5 or 6, and R1, R2, R3, R4, R5 and R6 are each H or OH.

TABLE 1

| | Example 1 | Example 2 | Example 3 | Comparative Example 1 | Comparative Example 2 |
|---|---|---|---|---|---|
| a | 7 | 18 | 20 | 5 | 39 |
| b | 52 | 39 | 41 | 38 | 31 |
| c | 41 | 43 | 39 | 57 | 30 |
| Mineral oil content wt % | 90 | 90 | 90 | 90 | 90 |
| Bentonite clay content wt % | 1 | 1 | 1 | 1 | 1 |
| Glycerol trioleate content wt % | 9 | 9 | 9 | 9 | 9 |
| Cutting oil + SiC = 1:1 layer separation | No layer separation | No layer separation | No layer separation | Layer separation (3 mm) | No layer separation |
| Dispersibility | Good | Good | Good | Poor | Good |
| Viscosity (mPa · s @25° C.) | 90 | 100 | 120 | 70 | 180 |
| Wafer-cleaning time after sawing | 25 min | 30 min | 40 min | 65 min | 70 min |
| Wafer warpage after sawing | 9.9 μm | 7.5 μm | 7.7 μm | 13.8 μm | 12.2 μm |

As is apparent from Table 1, based on the results of evaluation of layer separation, dispersibility, viscosity, wafer-cleaning time after sawing, and wafer warpage after sawing, Examples 1 to 3, in which a of Chemical Formula 1 is 7 to 20, b of Chemical Formula 2 is 39 to 52, and c of Chemical Formula 3 is 39 to 41, were vastly superior than Comparative Examples 1 and 2.

B. Examples 4 to 6 and Comparative Examples 3 and 4: Evaluation of Mineral Oil Content In the cutting oil composition including mineral oil represented by Chemical Formulas 1 to 3, the values of a of Chemical Formula 1, b of Chemical Formula 2, and c of Chemical Formula 3 were fixed, and evaluation for quantitatively determining the mineral oil content was performed. The results are shown in Table 2 below.

TABLE 2

| | Example 4 | Example 5 | Example 6 | Comparative Example 3 | Comparative Example 4 |
|---|---|---|---|---|---|
| a | 18 | 18 | 18 | 18 | 18 |
| b | 39 | 39 | 39 | 39 | 39 |
| c | 43 | 43 | 43 | 43 | 43 |
| Evaluated oil content wt % | 90 | 70 | 80 | 60 | 99 |
| Bentonite clay content wt % | 1 | 1 | 1 | 1 | 1 |
| Glycerol trioleate content wt % | 9 | 29 | 19 | 39 | 0 |
| Cutting oil + SiC = 1:1 layer separation | No layer separation | No layer separation | No layer separation | Layer separation (2 mm) | Layer separation (5 mm) |
| Dispersibility | Good | Good | Good | Good | Fair |
| Viscosity (mPa · s @25° C.) | 100 | 132 | 115 | 158 | 88 |

As is apparent from Table 2, based on the results of evaluation of layer separation, dispersibility and viscosity, Examples 1 to 3, using 70 to 90 wt % of mineral oil, were vastly superior than Comparative Examples 3 and 4.

C. Examples 7 and 8 and Comparative Examples 5 to 7: Evaluation of Bentonite Content In the cutting oil composition including mineral oil represented by Chemical Formulas 1 to 3, the values of a of Chemical Formula 1, b of Chemical Formula 2, and c of Chemical Formula 3 were fixed, and evaluation for quantitatively determining the bentonite content was performed. The results are shown in Table 3 below.

TABLE 3

| | Example 7 | Example 8 | Comparative Example 5 | Comparative Example 6 | Comparative Example 7 |
|---|---|---|---|---|---|
| A | 18 | 18 | 18 | 18 | 18 |
| B | 39 | 39 | 39 | 39 | 39 |
| C | 43 | 43 | 43 | 43 | 43 |
| Evaluated oil content wt % | 90.0 | 89 | 91.0 | 90.5 | 86 |
| Bentonite clay content wt % | 1.0 | 2.0 | 0.0 | 0.5 | 5.0 |
| Glycerol trioleate content wt % | 9 | 9 | 9 | 9 | 9 |
| Cutting oil + SiC = 1:1 layer separation | No layer separation | No layer separation | Layer separation (7.5 mm) | Layer separation (2.0 mm) | No layer separation |
| Dispersibility | Good | Good | Poor | Fair | Good |
| Viscosity (mPa · s @25° C.) | 100 | 140 | 45 | 69 | 296 |

As is apparent from Table 3, based on the results of evaluation of layer separation, dispersibility and viscosity, Examples 7 and 8, using 1 to 2 wt % of bentonite, were vastly superior than Comparative Examples 5 to 7.

D. Examples 9 to 11 and Comparative Examples 8 and 9: Evaluation of Glycerol Trioleate Content In the cutting oil composition including mineral oil represented by Chemical Formulas 1 to 3, the values of a of Chemical Formula 1, b of Chemical Formula 2, and c of Chemical Formula 3 were fixed, and evaluation for quantitatively determining the glycerol trioleate content was performed. The results are shown in Table 4 below.

TABLE 4

| | Example 9 | Example 10 | Example 11 | Comparative Example 8 | Comparative Example 9 |
|---|---|---|---|---|---|
| A | 18 | 18 | 18 | 18 | 18 |
| B | 39 | 39 | 39 | 39 | 39 |
| C | 43 | 43 | 43 | 43 | 43 |
| Evaluated oil content wt % | 90.0 | 79.0 | 84.0 | 94.0 | 98.9 |
| Bentonite clay content wt % | 1.0 | 1.0 | 1.0 | 1.0 | 1.0 |
| Glycerol trioleate content wt % | 9.0 | 20.0 | 15.0 | 5.0 | 0.1 |
| Cutting oil + SiC = 1:1 layer separation | No layer separation | No layer separation | No layer separation | No layer separation | Layer separation (2.0 mm) |
| Dispersibility | Good | Good | Good | Fair | Fair |
| Viscosity (mPa · s @25° C.) | 100 | 119 | 108 | 89 | 74 |

As is apparent from Table 4, based on the results of evaluation of layer separation, dispersibility and viscosity, Examples 9 to 11, using 9 to 20 wt % of glycerol trioleate, were vastly superior than Comparative Examples 8 and 9.

Based on the above results, when using 70 to 90 wt % of mineral oil in which a of Chemical Formula 1 is 7 to 20, b of Chemical Formula 2 is 39 to 52 and c of Chemical Formula 3 is 39 to 41, 1 to 2 wt % of bentonite, and 9 to 20 wt % of glycerol trioleate, layer separation, dispersibility, viscosity, wafer-cleaning time after sawing, and wafer warpage after sawing were evaluated to be significantly superior.

All simple modifications or variations of the present invention that may be easily performed by those skilled in the art are incorporated in the scope of the present invention.

The invention claimed is:

1. A cutting oil composition, comprising a mixture of mineral oil represented by Chemical Formula 1, mineral oil represented by Chemical Formula 2 and mineral oil represented by Chemical Formula 3, wherein Formula 1 is R1-(CnH2n−4)a-R2, wherein Formula 2 is R3-(CnH2n−2)b-R4, wherein Formula 3 is R5-(CnH2n)c-R6, wherein n is 5 or 6, and R1, R2, R3, R4, R5 and R6 are each H or OH, and wherein a is 7 to 20 b is 39 to 52 and c is 39 to 41.

2. The cutting oil composition of claim 1, further comprising a thickener and a dispersant.

3. The cutting oil composition of claim 2, wherein the thickener is bentonite clay and the dispersant is glycerol trioleate.

4. The cutting oil composition of claim 3, comprising 65 to 93 wt % of the mixture of mineral oil, 0.7 to 3 wt % of the bentonite clay, and 5 to 35 wt % of the glycerol trioleate.

5. The cutting oil composition of claim 4, comprising 70 to 90 wt % of the mixture of mineral oil, 1 to 2 wt % of the bentonite clay, and 9 to 29 wt % of the glycerol trioleate.

* * * * *